US005421034A

United States Patent [19]

Keune

[11] Patent Number: 5,421,034

[45] Date of Patent: Jun. 6, 1995

[54] MOISTURE RETENTION ATHLETIC SOCK HAVING RESILIENT CUSHIONING ATTACHMENT

[75] Inventor: Jeff M. Keune, Monarch Beach, Calif.

[73] Assignee: David Easton, Tustin, Calif. ; a part interest

[21] Appl. No.: 224,890

[22] Filed: Apr. 8, 1994

[51] Int. Cl.[6] ..... A41B 11/00; A41D 13/00

[52] U.S. Cl. ..... 2/239; 2/22

[58] Field of Search ..... 2/22, 239, 240, 241; 602/27, 65; 36/102, 113, 114

[56] References Cited

U.S. PATENT DOCUMENTS

| | | | |
|---|---|---|---|
| 3,003,154 | 10/1961 | Litman | 2/239 |
| 4,141,358 | 2/1979 | DeMarco | 602/65 |
| 4,373,361 | 2/1983 | Thorneburg | 2/241 X |
| 4,409,976 | 10/1983 | Pence | 602/65 |
| 4,575,954 | 3/1986 | Bye | 2/240 X |
| 4,669,126 | 6/1987 | Jones | 2/239 X |
| 4,723,322 | 2/1988 | Shelby | 2/22 X |
| 4,769,854 | 9/1988 | Williams | 2/22 |
| 4,864,741 | 9/1989 | Beauchemin | 2/239 X |
| 4,898,007 | 2/1990 | Dahlgren | 2/239 X |
| 5,095,548 | 3/1992 | Chesebro, Jr. | 2/239 |

FOREIGN PATENT DOCUMENTS

| | | | |
|---|---|---|---|
| 1463210 | 12/1966 | France | 2/239 |
| 2635952 | 3/1990 | France | 2/239 |
| 1015364 | 9/1957 | Germany | 2/239 |

*Primary Examiner*—John J. Calvert
*Attorney, Agent, or Firm*—Erik M. Arnhem

[57] ABSTRACT

An athletic sock is formed out of a moisture-absorbent yarn material that is knitted to conform to the shape of a human foot. A flexible sheet of neoprene, or similar resilient thermal insulator material, is affixed to the moisture-absorbent fabric so as to overlie the shin area, ankle area and instep area of the sock. The neoprene sheet acts as a cushion between the person's boot and foot so as to improve foot comfortability. The neoprene sheet also acts as a thermal barrier to control the escape of heat and moisture from the sock areas in contact with the neoprene sheet.

9 Claims, 1 Drawing Sheet

MOISTURE RETENTION ATHLETIC SOCK HAVING RESILIENT CUSHIONING ATTACHMENT

BACKGROUND OF THE INVENTION

1. Field of The Invention

This invention relates to athletic socks, particularly socks worn in relatively stiff boots, where foot comfort may be a problem. Socks of the present invention are especially designed for use by persons engaged in winter sports, e.g. ice skating, skiing, mountain climbing, outdoor camping and snowboarding, where boots are worn.

2. Prior Developments

Persons engaged in winter sports often wear relatively stiff boots, as protection against snow or the weather elements entering into the footwear to thereby make the feet feel unconfortable. However, the stiffness of many boots is itself a source of foot discomfort. The problem is more difficult since the boot has to feel comfortable, while at the same time keeping the feet warm. One solution is to wear multiple pairs of socks, so as to increase the cushioning action and the thermal insulative action.

Boots used in snowboarding have metal eye loops and laces that can be a source of foot discomfort. The binding system requires the wearer to buckle the binding down tight into the foot, which in turn presses the eye loops of the boot into the top (instep) of the foot, causing some foot discomfort. Boots used in other sports, such as ice skating, skiing and hiking, have similar problems. The problem of keeping the feet comfortable and warm in sub-freezing temperatures, is affected partly by the fact that sweat or moisture generated by the athletic activity (e.g. ice skating) tends to work through the sock so as to form a thermal bridge between the boot and the person's foot. Heat travels from the foot through the relatively conductive moist sock material to the relatively cold boot, thereby rapidly cooling the foot to an undesirably cold and uncomfortable condition.

In an effort to avoid such undesired heat loss there have been developed socks formed of imperforate neoprene. The neoprene, in sheet form, acts as a thermal barrier to slow down, or completely stop, the escape of heat from the person's foot to the boot. An imperforate neoprene sock fully encircling the person's foot is however not fully satisfactory, since it may prevent the foot from perspiring or breathing in normal fashion. The complete thermal barrier provided by an imperforate neoprene sock traps sweat between the persons's skin and the neoprene surface, such that a resistance to further sweating is established. The foot senses the resistive condition and stops sweating, thereby eventually causing the skin surface to cool down to an undesired extent.

Various porus, moisture-abosorbent socks have been developed as an alternative to the imperforate neoprene sock. U.S. Pat. Nos. 3,341,096 and 4,898,007 and 5,095,548 are representative patents showing socks knitted out of various hydrophilic and hydrophobic yarns in different combinational arrangements, so as to control the escape of moisture from the person's foot.

A hydrophilic yarn, such as cotton, is moisture-absorbing and moisture conducting, so as to act like a wick for transporting moisture from a relatively wet area of the sock to a relatively dry area. A hydrophobic yarn has relatively slight affinity for water, such that the moisture tends to collect on the yarn surface, where it can be removed by evaporation or collect as free condensate, depending on its temperature.

The above-mentioned patents show sock constructions, wherein some areas of the sock are formed primarily of hydrophilic yarns, and other areas of the sock are formed primarily of hydrophobic yarns, whereby moisture generated by the person's foot is transported to specific areas of the sock for evaporative removal. Heat is retained in the in the moist sock material so as to keep the person's foot relatively warm and comfortable. Water has a relatively high specific heat, so that a relatively thin film of water on the sock is able to hold relatively large quantities of heat.

The porosity of the knitted socks described in the above-noted patents, may be a problem in that the moistened yarns and yarn surfaces may form unobstructed thermal paths between the person's foot and the boot interior surface, such that the socks will not serve their intended when worn for prolonged periods of time in sub-freezing conditions.

U.S. Pat. No. 4,373,361 to I. Thornelburg, shows a knitted ski sock formed of hydrophilic and hydrophobic yarns for heat management purposes. Additonally the yarn layers are increased or thickened in selected areas of the sock so as to form a cushion between the boot and the person's skin. The cushion acts as a spacer, thereby making the sock more comfortable on the person's foot.

SUMMARY OF THE INVENTION

The present invention relates to an athletic sock that comprises a knitted porous fabric formed out of moisture-absorbing yarn, e.g. cotton, and having a flexible covering sheet of neoprene, or similar thermal insulator material, extending over the shin area, ankle area and instep area of the sock. Other areas of the sock, e.g. the toe, heel and sole, are left uncovered.

The flexible covering sheet acts as a cushion to prevent forcible pressure contact between the hard boot and the shin, ankle and instep areas of the person's foot, as would make the boot feel uncomfortable. The flexible covering sheet also forms a thermal barrier between the boot and the sock areas in direct contact with the person's ankle, shin and instep, whereby those areas of the foot are kept relatively warm.

The flexible neoprene covering is concentrated primarily on the the upwardly facing, (or forwardly facing) areas of the sock, such that the sock has approximately the same flexibility and stretchability as a conventional cotton athletic sock. When worn, the sock of the present invention has essentially the same feel as a conventional sock, as regards stiffness, flexibility and stretchability.

The sole area of the sock provides a zone where moisture can collect and possibly vaporize. Moisture generated on the sole area of the foot has an escape path around the neoprene barrier sheet so that the foot is allowed to perspire in an essentially normal fashion. Heat generated by the perspiring foot is allowed to escape in a controlled fashion, while the foot is kept relatively warm.

THE DRAWINGS

DESCRIPTION OF A PREFERRED EMBODIMENT OF THE INVENTION

Figure 1:
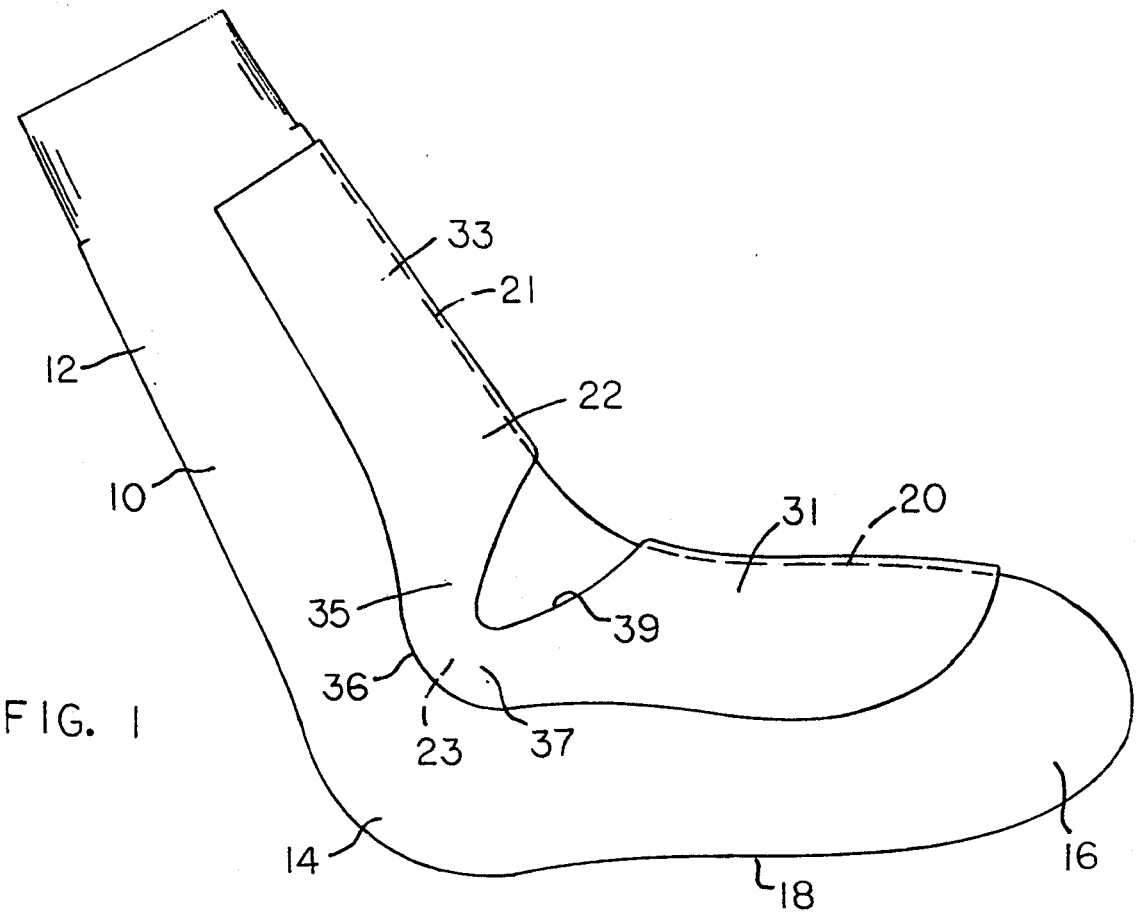
FIG. 1 is a side elevational view of an athletic sock contructed according to the invention.

FIG. 1 shows an athletic sock comprising a knitted porous fabric 10 formed out of a moisture-absorbing yarn material, e.g. cotton yarn. The fabric material is adapted to fit closely (snugly) on a person's foot within a boot, not shown. The fabric sock is particularly intended for use by person's engaged in winter activities, such as ice skating snowboarding, skiing, hiking, and camping; the boot will be selected according to the particular activity involved.

Fabric 10 comprises a tubular area 12 adapted to encircle the lower leg area of the person (including the shin), a second area 14 adapted cover the person's heel, a third area 16 adapted to surround the person's toes, a fourth area 18 adapted to underlie the sole of the person's foot, and a fifth area 20 adapted to overlie the instep of the person's foot.

During an athletic activity moisture generated by the person's foot will permeate the knitted fabric 10 so as to form a water film within the pores of the fabric and within the moisture-absorbent yarn material. Since water has a relatively high specific heat it will retain heat relatively efficiently on or near the skin surface. Heat generated within the foot is retained by the sock fabric 10 even though the fabric is in a moist (wet) condition.

However, the moist fabric 10 material has a disadvantage in that it acts as a thermal conductor between the foot and the relatively cool interior surface of the associated boot. The water film on fabric 10 conducts heat from the person's foot to the boot. To minimize this conductive heat loss the sock is provided with a flexible thermal insulator sheet 22 preferably formed of neoprene. The required characteristics for sheet 22 are that it be a thermal insulator, flexible, and resilient. Sheet neoprene, having a thickness of about 0.08 inches, is a preferred material.

Sheet 22 is sized and configured so as to extend along shin area 21 (i.e. the front surface of tubular area 12), ankle area 23, and instep area 20, of the porous fabric sock material 10. Sheet 22 is preferably attached to fabric material 10 by stitching that runs along the peripheral edge of sheet 22.

Figure 2:
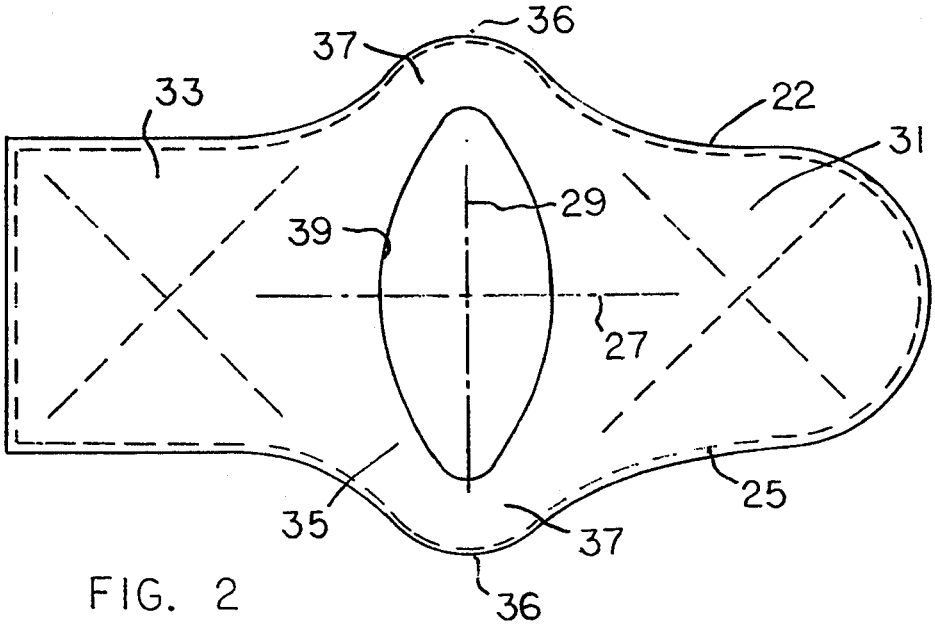
FIG. 2 is a plan view of an insulator sheet used in the FIG. 1 sock.

FIG. 2 shows sheet 22 in a flat condition prior to attachment of the sheet to the fabric material 10. For illustration purposes the stitching used for attaching sheet 22 to fabric material 10 is designated by dashed lines 25 in FIG. 2. The stiching extends along the entire peripheral edge of sheet 22. Additional stitching can be used across the face of sheet 22.

Sheet 22 has a longitudinal axis 27 and a transverse axis 29. The sheet is arranged in fabric 10 so that zone 31 of the sheet overlies the instep area 20 of the porous fabric, and zone 33 of the sheet overlies shin area 21 of the porous fabric. The neoprene sheet material has sufficient flexibility that it can wrap transversely around the fabric 10 material so as to extend downwardly (or rearwardley) along the side surfaces of the sock fabric.

Central zone 35 of the neoprene sheet has curved side edges 36 spaced relatively far away from longitudinal axis 27 such that zone 35 of the sheet is wider than the other two zones 31 and 33. Central zone 35 forms two ears 37 that are adapted to overlie the ankle area of the sock (above heel area 14). In order to insure continuous facial engagement between neoprene sheet 22 and fabric sock material 10, without undesired wrinkling or buckling of the sheet material, the neoprene sheet is provided with an oval cut-out (or opening) 39 in zone 35 of the sheet. When sheet 22 is placed over fabric 10 the oval opening 39 is located at the juncture between shin area 21 and instep area 20 so as to form a relief opening that enables the neoprene sheet to fit smoothly on the fabric 10, without distorting the fabric or forming corrugations or folds in sheet 22 when the sock is worn. As previously noted, sheet 22 is preferably stitched along its peripheral edge to the fabric 10 so as to assume the position depicted in FIG. 1.

Neoprene sheet 22 acts as a thermal barrier to block the thermal path that would otherwise exist between the shin area, ankle area, and instep area of the sock and corresponding areas of the associated boot. Moisture and heat are trapped within fabric 10 and beneath neoprene sheet 22, whereby the person's foot is kept relatively warm.

Sole area of 18 of the sock is uncovered, such that moisture can escape and possibly vaporize, depending on temperatures realized by the fit of the boot on the person's foot. The escapage of moisture allows the foot to breathe and keep perspiring in an essentially normal fashion.

Neoprene sheet 22 acts as a thermal barrier between the sock and the person's boot. The neoprene sheet also acts as a resilient cushion to soften the hardness of the contact between the boot interior surfaces and the person's foot. The cushioning is provided at those areas of the foot where the boot is likely to produce the greatest discomfort, i.e. the shin area, ankle area, and instep.

Neoprene sheet 22 is preferably sized so that its longitudinal length parallel to axis 27 is about twice its its transverse width parallel to transverse axis 29. Front edge 39 of the neoprene sheet preferably has an arcuate semi-circular contour in order to improve the confortability of the sock on the person's foot. Neoprene sheet 22 partially wraps around fabric 10, such that the finished sock has approximately the same flexibility as a conventional knitted cotton sock.

Neoprene sheet 22 can be imperforate, as shown in the drawings. Alternately sheet 22 can have small perforations extending therealong to achieve limited escape of moisture from the fabric 10 material in contact with the neoprene sheet.

I claim:

1. An athletic sock for disposition on a foot within an associated boot; said sock comprising a knitted porous fabric formed of a moisture-absorbing yarn, the porous moisture-absorbing fabric comprising contiguous fabric sections to fully cover shin, ankle, heel, toe, sole, and instep areas of the foot, whereby moisture generated during athletic indeavors is distributed throughout the porous fabric; and a flexible sheet of a moisture-impervious insulator material covering selected areas of said knitted porous fabric to trap heat within said selected fabric areas; said flexible sheet attached to the sock and extending only along the shin area, ankle area and instep area of the porous fabric, wherein other areas of the porous fabric are uncovered; said flexible sheet having an opening at a juncture between the shin area and instep area allowing the flexible sheet continuous facial engagement with the porous fabric without wrinkling or buckling at said juncture; the material for said flexible sheet being resilient wherein said sheet affords cushioning between the foot and associated boot.

2. The athletic sock of claim 1, wherein said flexible sheet is formed of neoprene.

3. The athletic sock of claim 1, wherein said flexible sheet is formed of neoprene with a thickness of about 0.08 inches.

4. The athletic sock of claim 1, wherein said flexible sheet has a longitudinal axis spanning the instep area and shin area of the porous fabric; said opening in the flexible sheet having an oval configuration, said oval having a major axis transverse to the longitudinal axis of the flexible sheet.

5. The athletic sock of claim 4, wherein said flexible sheet has a length dimension parallel to the longitudinal axis, and a width dimension transverse to the longitudinal axis; the length dimension of said flexible sheet being about twice the width dimension.

6. The athletic sock of claim 4, wherein said flexible sheet comprises a first zone having a width covering the instep area of the porous fabric, a second zone having a width covering the shin area of the porous fabric, and a third zone covering the ankle area of the porous fabric; said third zone having a greater width than said first and second zones; said oval opening being located in said third zone.

7. The athletic sock of claim 6 wherein said third zone forms a front edge of said flexible sheet; said front edge being generally semi-circular.

8. The athletic sock of claim 1, wherein said flexible sheet has a peripheral edge, and stitching extending along said peripheral edge for joining said flexible sheet to said porous fabric.

9. The athletic sock of claim 1, wherein said flexible sheet is imperforate.

* * * * *